United States Patent [19]

Kihn

[11] Patent Number: 4,819,389

[45] Date of Patent: Apr. 11, 1989

[54] INFLATABLE TENT

[76] Inventor: John P. Kihn, 200 Montura Way, Novato, Calif. 94947

[21] Appl. No.: 101,524

[22] Filed: Sep. 28, 1987

[51] Int. Cl.[4] ..... E04B 1/34

[52] U.S. Cl. ..... 52/2; 135/97

[58] Field of Search ..... 52/2 K; 135/94–97

[56] References Cited

U.S. PATENT DOCUMENTS

| | | | |
|---|---|---|---|
| 2,591,829 | 4/1952 | Katzenmeyer et al. | 52/2 K |
| 2,754,836 | 7/1956 | Darby | 52/2 K |
| 2,762,928 | 7/1956 | Barker | 52/2 K |
| 3,145,719 | 8/1964 | Johnson | 135/1 |
| 3,456,403 | 7/1969 | Batterson | 52/2 |
| 3,840,919 | 10/1974 | Middleton | 5/343 |
| 3,899,853 | 8/1975 | Wertman | 52/2 |
| 3,970,096 | 7/1976 | Nicolai | 135/94 |
| 4,068,418 | 1/1978 | Masse | 52/2 |
| 4,197,681 | 4/1980 | Holcombe | 52/2 |
| 4,295,302 | 10/1981 | Liu | 52/2 |
| 4,332,112 | 6/1982 | Hsu | 52/2 |
| 4,335,545 | 6/1982 | Couch | 52/2 |
| 4,340,626 | 7/1982 | Rudy | 52/2 K |
| 4,384,435 | 5/1983 | Polise et al. | 52/2 |
| 4,404,980 | 9/1983 | Wade | 135/97 |

FOREIGN PATENT DOCUMENTS

| | | | |
|---|---|---|---|
| 1372039 | 8/1964 | France | 52/2 K |

*Primary Examiner*—James L. Ridgill, Jr.

*Attorney, Agent, or Firm*—Townsend and Townsend

[57] ABSTRACT

A tent uses outer and inner inflatable frame sections secured to one another in an inner-outer relationship to provide improved rigidity and support, and improved structural integrity upon puncture of one of the inflatable sections. The tent is provided with an inflatable base to which the first and second frame sections are secured. The tent covering is secured between the first and second frame sections. A rain fly draped over the outer frame section can be maintained spaced apart from the tent covering material. The shape and arrangement of frame sections and base provide a tent which is stable, rigid, and free-standing.

16 Claims, 1 Drawing Sheet

INFLATABLE TENT

BACKGROUND OF THE INVENTION

1. Field of the Invention

The present invention relates generally to tents, and more specifically to a tent having dual inflatable frame members.

2. Description of the Relevant Art

Tents having inflatable frame elements have been known for some time. An example of such a tent is shown in U.S. Pat. No. 3,145,719, issued to Johnson, dated Aug. 25, 1964, which shows at FIG. 2 an inflatable frame wherein each frame section is individually inflatable See also, U.S. Pat. No. 4,197,681, issued to Holcombe, dated Apr. 15, 1980, U.S. Pat. No. 4,068,418, issued to Masse, dated Jan. 17, 1978, and U.S. Pat. No. 3,840,919, issued to Middleton, dated Oct. 15, 1974, each showing a tent having an inflatable frame structure.

It should be noted that each of the above-mentioned patents discloses a tent structure wherein fabric or other material is stretched over or between inflatable frame sections to form a tent structure. Each of the frames taught in the above-mentioned patents include a plurality of sections, the sections being either individually inflatable or inflatable together as a single unit.

The major drawback of each and every presently existing inflatable tent structure is the fact that if one section of the inflatable structure develops a leak, rigidity of the frame structure at that section is lost. This is especially true in inflatable frame structures which are inflatable as a single unit, but is nonetheless true of frame structures composed of individually inflatable frame elements.

Thus, there is a present need in the art for an inflatable frame structure such that should one section of the frame structure develop a leak, rigidity of the frame structure at that section is not compromised.

SUMMARY OF THE INVENTION

The present invention is directed to an inflatable tent structure which is easy to erect and take down, which is light-weight, has a roomy interior, is stable without the need to secure the tent structure to the ground, and which does not lose rigidity upon puncturing of frame sections.

The present invention provides an inflatable tent structure having a first inflatable frame which defines an interior section of the tent, the first inflatable frame including a number of interconnecting first frame elements which define openings into the interior region. A second inflatable frame, independently inflatable of the first inflatable frame, includes a number of interconnecting second frame elements which are joined to the first frame elements such that the second frame elements are in the interior region defined by the first inflatable frame. Supporting fabric is secured between the first and second frame elements at at least one of the openings and preferably all of the openings defined by the first frame elements.

The tent is preferably provided with supporting fabric at its end faces such that at at least one of the end faces the fabric acts as a door.

In the preferred embodiment, the inflatable tent structure has several inverted U-shaped sections which define the longitudinal cross-sectional shape of the tent structure. The terminus of each of the inverted U-shaped sections is connected to an inflatable base, such as an air mattress. Extending between, and terminating at, each inverted U-shaped section are a plurality of longitudinal elements. The cross sections of each of the inverted U-shaped sections and the longitudinal elements are preferably circular, having a bisecting element dividing the circular cross-section roughly in half, and thereby defining an inner and outer region of each. The outer sections of each U-shaped element and longitudinal member communicate with one another such that they are inflatable together as a single unit, thus forming the first inflatable frame. Similar communication exists between the inner regions of the inverted U-shaped sections and the inner regions of the longitudinal sections, such that they are inflatable as a single unit forming the second inflatable frame. The inflatable base, or air mattress, is inflatable independently of either or both the inner and out inflatable sections.

The user inflates, individually, the inner sections, outer sections, and air mattress, thus establishing the tent structure. The user then may place therein a sleeping bag, blankets, or other sleeping arrangement by means of the opening in one end of the tent.

The advantages of the present invention are that the present tent structure has a backup, or secondary frame, such that such should either inflatable frame (first or second) develop a leak, the other respective frame section will maintain the rigidity of the text structure.

A further advantage of tee present invention is that a rigid tent structure may be assembled merely by inflating an inner and outer frame section and an air mattress. The tent structure so assembled may stand free, such that it need not be secured to the ground, trees, etc., in order to maintain its stability.

A further advantage of the present invention is that a rain fly may be installed over the tent simply by draping it over the outer tube sections. The rain fly so installed is in a spaced-apart relation from the supporting fabric at a distance equal to the height of the outer frame section. Thus, moisture cannot leak or bleed-through due to capillary action between the rain fly and the supporting fabric.

These, and other objects, features, and advantages of the present invention will become apparent upon consideration of the following detailed description and figures.

DETAILED DESCRIPTION OF THE PREFERRED EMBODIMENT

Figure 1:
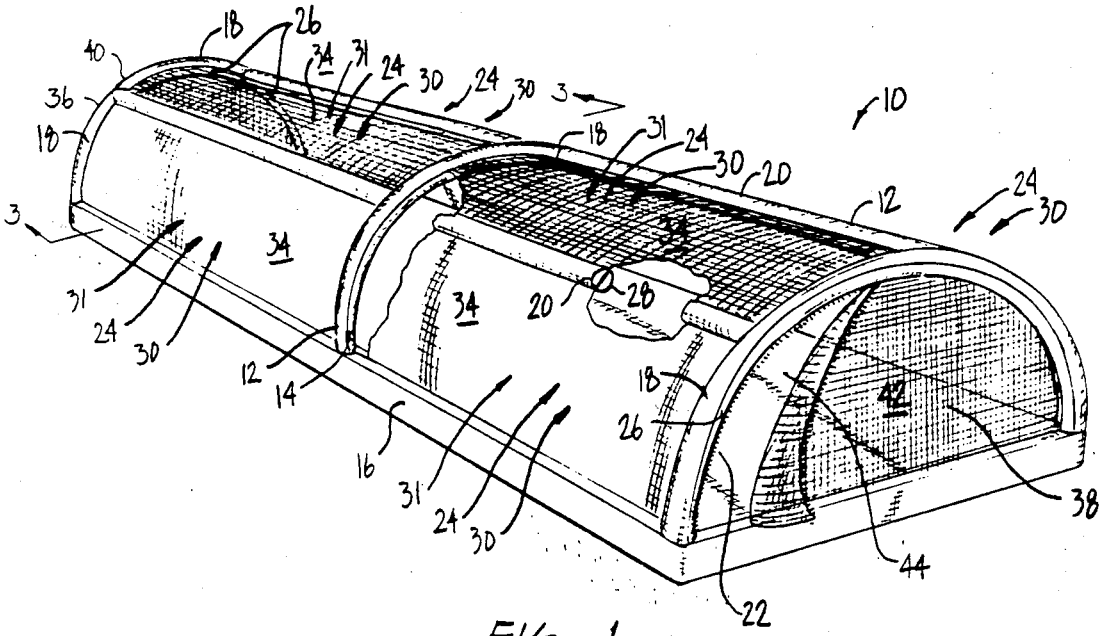
FIG. 1 is a perspective view of a tent structure according to the present invention.

FIG. 1 shows an inflatable tent structure 10 according to a preferred embodiment of the present invention. Tent structure 10 includes an outer frame 12, an inner frame 14, and an inflatable base 16. Outer frame 12, inner frame 14, and inflatable base 16 are secured to one another so as to form an integrated tent structure.

Outer frame 12 includes arcuate support frame elements 18, in a preferred embodiment numbering three. Extending between arcuate support frame elements 18 are a plurality of longitudinal frame elements 20. Each of frame elements 18 and 20 is interconnected and communicates so as to form a single, inflatable unit (i.e., outer frame 12). Arcuate support frame elements 18 and longitudinal frame elements 20 form outer frame 12 so as to define an interior region 22. Frame elements 18, 20 are interconnected so as to define openings 24 therebetween.

Inner frame 14 is substantially identical to outer frame 12. Inner frame 14 consists of a plurality of arcuate support frame elements 26, and a plurality of longitudinal frame elements 28. As with the arcuate support frame elements 18 and longitudinal frame elements 20 of outer frame 12, arcuate support frame elements 26 and longitudinal frame elements 28 define a plurality of openings 30 therebetween. Inner frame 14, however, is sized so as to fit against outer frame 12 in interior region 22 so that openings 24, 30 are opposite one another and form a common opening 31.

Figure 2A:
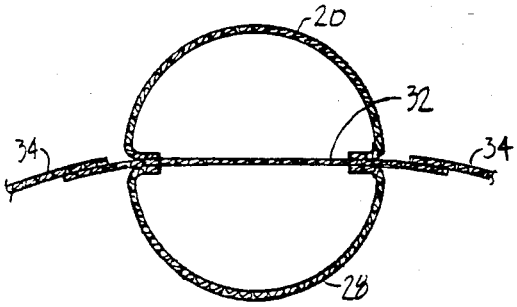
FIGS. 2A and 2B are cross-sectional views of inner and outer frame elements according to two embodiments of the present invention: and, FIG. 3 is a cutaway end view of a tent structure showing a rain fly according to the present invention.
Figure 2B:
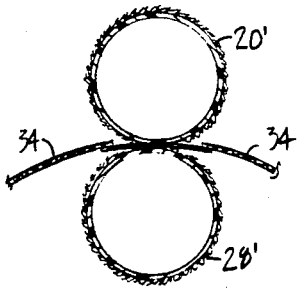

FIG. 2A illustrates the manner in which outer frame 12 is secured to inner frame 14. FIG. 2A shows, by way of example, a typical longitudinal frame element 20 of outer frame 12 secured to a typical longitudinal frame element 28 of inner frame 14. A similar arrangement applies to the relationship between arcuate support frame elements 18, of outer frame 12 and arcuate support frame elements 26 of inner frame 14. The example of a preferred arrangement is described with reference to longitudinal frame elements 20, 28 only, for brevity. Outer frame 12 is joined to inner frame 14 by means of a common central wall between longitudinal frame elements 20 and 28. Typically, the connection between outer frame 12 and inner frame 14 is such that a circular cross section is formed. This is as illustrated in FIG. 2A. It should be appreciated that many other possible arrangements for connecting outer frame 12 and inner frame 14 are possible within the spirit and scope of the present invention. One such variation is shown in FIG. 2B. As with FIG. 2A, FIG. 2B illustrates a typical longitudinal frame element 20' of outer frame 12 joined to a corresponding longitudinal frame element 28' of inner frame 14. In FIG. 2B the two elements do not share a common wall but are joined along their circumferences. The important point is that outer frame 12 and inner frame 14 are independently inflatable frames which are joined together in an outer and inner relationship relative to inner region 22.

Referring again to FIG. 1, there is shown support fabric 34, secured between openings 24, 30. Support fabric 34 may be one or more of a variety of types, ranging from tightly-woven translucent material to loosely woven open mesh material. The type of support fabric 34, be it loosely woven mosquito netting or tightly woven, waterproof material, for the different openings 24, 30 can be varied according to circumstances and personal preference. For example, support fabric 34 in one or more of openings 24, 30 may be of an open weave mesh material so as to provide a window through which an occupant inside the tent structure may look out and to provide circulation of air within and without the tent.

Inflatable tent structure 10 includes end faces 36, 38, defined by arcuate support frame elements 18, 26. Disposed entirely within arcuate support frame elements 18, 26 at end faces 36, 38, is end face fabric 40, 42. End face fabric 40 and/or 42 is openingly secured to arcuate support frame elements 18, arcuate support frame elements 26, and/or inflatable base 16 such that an openable door or passage 44 is provided. The end face fabric 40, 42 may be openably secured by means of a zipper, VELCRO, etc.

Attached to the terminus of each of the arcuate support frame elements 18, 26, is inflatable base 16, which may be an air mattress of a standard type well-known in the art or other inflatable base structure. Inflatable base 16 is of a size to match the span of arcuate support frame elements 18, 26, i.e., arcuate support frame elements 18, 26 secure at or near the edges of inflatable base 16. In a preferred embodiment, each of outer frame 12, inner frame 14, and inflatable base 16 is an independently inflatable unit. It may be the case, however, that inflatable base 16 communicates with either outer frame 12 or inner frame 14 such that the two are inflatable as a single unit. Support fabric 34 and end face fabric 40, 42 are secured to inflatable base 16 at those points where inflatable base 16 is one side defining openings 24, 30. Again, support fabric 34 and end face fabric 40, 42 are secured so as to completely fill openings 24, 30 and so that one or both of end faces 36, 38 is or are openly secured to inflatable base 16. In this way, with door or opening 44 secured shut, outer frame 12, inner frame 14, inflatable base 16, support fabric 34, and end face fabric 40, 42 define a fully enclosed tent structure.

Figure 3:
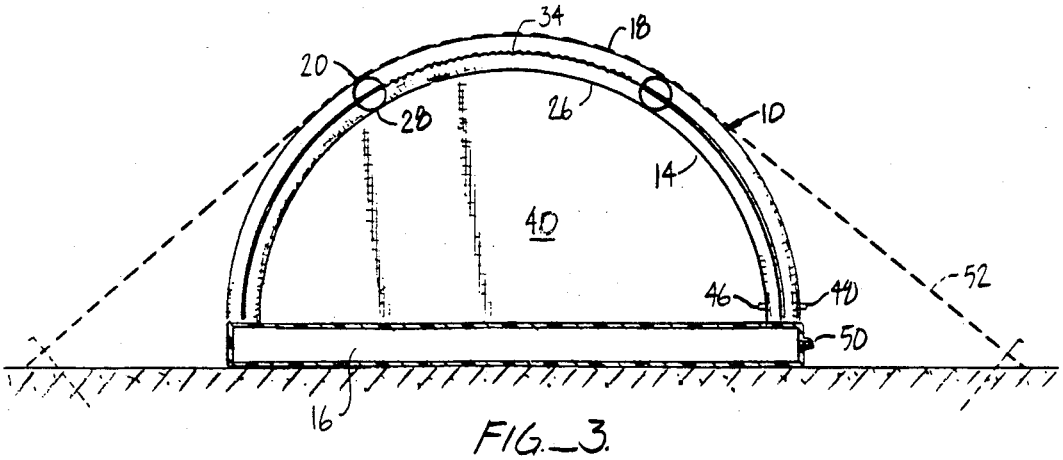

A rain fly 52, as shown in FIG. 3, may be provided. Generally, rain fly 52 will sit atop outer frame 12 such that it lies in spaced apart relation from support fabric 34. The spacing between rain fly 52 and support fabric 52 will be approximately equal to the height of arcuate support frame elements 18 and longitudinal frame elements 20. The advantage of this spaced apart relationship is that moisture accumulating on the surface of rain fly 52 is prevented from leaking or bleeding through support fabric 34 into interior region 22 by capillary action. Rain fly 52 may be secured to the ground, trees, etc., or the tent itself in proper circumstances.

In operation a user would inflate each of the independently inflatable ®units, for illustration purposes outer frame 12, inner frame 14, and inflatable base 16, at valves 46, 48, and 50, respectively. The inflated sections define the shape of the inflatable tent structure. Once inflated, the user may enter the tent into interior region 22 through door or opening 44. As well, the user may place a sleeping bag, blankets, etc., if appropriate (not shown) in interior region 22. When not in use, inflatable tent structure 10 may be deflated and folded to a small size and light weight for ease of stowage.

To those skilled in the art to which this invention relates, many changes in construction and application, and widely differing embodiments and combinations of the present invention will suggest themselves without departing from its spirit and scope. For example, inflatable base 16 may be of a tapered plan such that inflatable tent structure 10 narrows from one end to another along a longitudinal axis. Indeed, the entire shape of inflatable tent structure 10 may be one of a wide variety including a part-tubular shape, a rectangular shape, a dome shape, etc. Therefore, the disclosures and descriptions herein are merely illustrative and are not intended to be in any sense limiting.

What is claimed is:

1. An inflatable tent structure, comprising:

a first inflatable frame defining an interior region, said first inflatable frame including a plurality of interconnecting first frame elements defining openings into said interior region;

a second inflatable frame, independently inflatable of said first inflatable frame, said second inflatable frame including a plurality of interconnecting second frame elements, said second inflatable frame sized and positioned such that said second inflatable frame fits entirely within the interior region relative to said first inflatable frame; and supporting fabric secured to at least one of said first and second frames to cover at least one of said openings.

2. The inflatable tent structure of claim 1, wherein said first and said second frames define an entrance opening sized for passage of a user into and out of the tent.

3. The inflatable tent structure according to claim 1, wherein said first inflatable frame is adapted to support a rain fly in spaced apart relation to said supporting fabric.

4. The inflatable tent structure according to claim 1, wherein said supporting fabric includes a permeable mesh material.

5. The inflatable tent structure according to claim 1, wherein said second inflatable frame is of substantially identical shape to said first inflatable frame.

6. The inflatable tent structure according to claim 1, further comprising an inflatable base member to which each said first and second inflatable frames are secured.

7. The inflatable tent structure according to claim 6, said supporting fabric connects to said base member and said first and said second inflatable frames.

8. The inflatable tent structure according to claim 1, wherein said interconnecting elements consist of a plurality of arcuate transverse members together with a plurality of linear longitudinal members, said linear longitudinal members extending between, and terminating at, said arcuate transverse members.

9. The inflatable tent structure according to claim 8, wherein said arcuate transverse members and said linear longitudinal members define a plurality of wall sections and roof sections, each having support fabric therewithin, said support fabric within said roof sections being of a mesh material and said support fabric within said wall sections being of a more tightly woven mesh material than that of said roof sections, such that said support fabric within said wall sections is translucent.

10. The inflatable tent structure according to claim 8, wherein two of said arcuate transverse members form front and rear end members, respectively, the radius of arc of said front member being larger than the radius of arc of said rear member, such that the shape of said tent structure is of a frusto-conic section.

11. The inflatable tent structure according to claim 8, further comprising end-face fabric extending entirely within the area defined by, and in the plane of, the radius of each of said front and rear members, and wherein said end-face fabric is removably secured to one or both of each of said front and rear members.

12. An inflatable tent structure, comprising:

a first inflatable frame defining an interior region, said first inflatable frame including a plurality of interconnecting first frame elements defining openings into said interior region;

a second inflatable frame independently inflatable of said first inflatable frame, said second inflatable frame including a plurality of interconnecting second frame elements, said second inflatable frame being of substantially identical shape to said first inflatable frame, and sized and positioned such that said second inflatable frame fits entirely within the interior region relative to said first inflatable frame; and supporting fabric secured within at least one of said opening at the juncture of said first inflatable frame and said second inflatable frame such that said supporting fabric is secured between said first inflatable frame and said second inflatable frame.

13. The inflatable tent structure according to claim 12, wherein said support fabric includes a permeable mesh material.

14. The inflatable tent structure according to claim 12, wherein said first inflatable frame is adapted to support a rain fly in spaced apart relation to said supporting fabric.

15. The inflatable tent structure according to claim 14, wherein said rain fly comprises a sheet of waterproof material, draped over said first inflatable frame, spaced apart from said support fabric by said first inflatable frame.

16. An inflatable tent structure, comprising:

a first inflatable frame defining an interior region, said first inflatable frame including a plurality of interconnecting first frame elements defining opening into said interior region, said first frame elements including a plurality of arcuate transverse members together with a plurality of linear longitudinal members, said linear longitudinal members extending between and terminating at said arcuate transverse members such that two of said arcuate transverse members form front and rear end members, respectively, the radius of arc of said front member being larger than the radius of arc of said rear member such that the shape of said first inflatable frame is that of a frusto-conic section, and further said arcuate transverse members and said linear longitudinal members defining a plurality of wall sections and roof sections;

a second inflatable frame independently inflatable of said first inflatable frame independently inflatable of said first inflatable frame, said second frame elements, said second frame elements including a plurality of arcuate transverse members together with a plurality of linear longitudinal members, said linear longitudinal members extending between, and terminating at, said arcuate transverse members, wherein two of said arcuate transverse members form front and rear end members, respectively, the radius of arc of said front members being larger than the radius of arc of said rear members such that the shape of said second inflatable frame is that of a frusto-conic section, and further such that said arcuate transverse members, and said linear longitudinal members define a plurality of wall sections and roof sections, said second inflatable frame being of substantially identical shape to said first inflatable frame, and sized and positioned such that said second inflatable frame fits entirely within the interior region relative to said first inflatable frame;

an inflatable base member, to which each said first and said second inflatable frames are secured; and, supporting fabric secured within at least one of said openings at the juncture of said first inflatable frame and said second inflatable frame such that said supporting fabric is secured between said first inflatable frame and said second inflatable frame and further such that said supporting fabric connects said base member and said first and second inflatable frames such that at least one entry/exit opening is defined to allow entry into or exit from said interior region by a user, said supporting fabric being openly secured in said entry/exit opening.

* * * * *